US008732883B2

(12) United States Patent
Bauckman et al.

(10) Patent No.: US 8,732,883 B2
(45) Date of Patent: May 27, 2014

(54) SWIMMING POOL CLEANER DISCS

(75) Inventors: Mark Bauckman, San Marcos, CA (US); Hendrikus Johannes van der Meijden, Glen Austin (ZA); Michael Edward Moore, Blairgowrie (ZA)

(73) Assignee: Zodiac Pool Systems, Inc., Vista, CA (US)

( * ) Notice: Subject to any disclaimer, the term of this patent is extended or adjusted under 35 U.S.C. 154(b) by 213 days.

(21) Appl. No.: 13/280,052

(22) Filed: Oct. 24, 2011

(65) Prior Publication Data

US 2013/0097788 A1 Apr. 25, 2013

(51) Int. Cl.
*E04H 4/16* (2006.01)

(52) U.S. Cl.
USPC ..... 15/1.7; 15/246

(58) Field of Classification Search
USPC ..... 15/1.7, 246
See application file for complete search history.

(56) References Cited

U.S. PATENT DOCUMENTS

| | | | | |
|---|---|---|---|---|
| 4,351,077 | A | 9/1982 | Hofmann | |
| 4,530,125 | A | 7/1985 | Hofmann | |
| 4,949,419 | A | 8/1990 | Kallenbach | |
| 5,418,994 | A | 5/1995 | Rissik et al. | |
| 5,418,995 | A | 5/1995 | Rice et al. | |
| 5,421,054 | A | 6/1995 | Dawson et al. | |
| 5,433,985 | A | 7/1995 | Atkins | |
| 5,465,443 | A * | 11/1995 | Rice et al. | 15/246 |
| 5,617,606 | A | 4/1997 | Scott, II et al. | |
| 6,122,794 | A | 9/2000 | Atkins | |
| 7,987,542 | B2 * | 8/2011 | Moore et al. | 15/1.7 |

OTHER PUBLICATIONS

International Search Report and Written Opinion dated Mar. 18, 2013 in Application No. PCT/US2012/061420.

* cited by examiner

*Primary Examiner* — Shay Karls
(74) *Attorney, Agent, or Firm* — Dean W. Russell; Kilpatrick Townsend & Stockton LLP

(57) ABSTRACT

Detailed are components of cleaners of fluid-containing vessels such as pools and spas. The components may incorporate combined discs and footpads and attach to other components of a cleaner other than by receipt of a boundary of a central aperture into a groove. The components nevertheless may continue to include central apertures as appropriate.

26 Claims, 4 Drawing Sheets

SWIMMING POOL CLEANER DISCS

FIELD OF THE INVENTION

This invention relates to discs and associated components of cleaners of liquid-containing vessels and more particularly, although not necessarily, to hydraulic automatic swimming pool cleaners (APCs) having discs with nominally upwardly protruding connectors.

BACKGROUND OF THE INVENTION

U.S. Pat. No. 5,421,054 to Dawson, et al., and U.S. Pat. No. 5,465,443 to Rice, et al., describe various discs for, principally, APCs. Extending upward from the upper surfaces of the discs are multiple fins. Each disc includes a central aperture whose boundary is fitted into a separate footpad, which footpad in turn is connected to a cleaner body for use.

U.S. Pat. No. 5,617,606 to Scott, II, et al., details other discs for APCs. Projecting above the majorities of the upper surfaces are one or more flutes, whose edges may be curved or straight as desired. Similarly projecting upward at boundaries of central apertures of the discs may be pins or stops. When a disc is fitted into a separate footpad, the stops may cooperate with the footpad to inhibit misorientation of the disc.

Numerous other discs have been devised whose central apertures are received by separate footpads. U.S. Pat. No. 4,351,077 to Hofmann and U.S. Pat. No. 4,949,419 to Kallenbach illustrate examples of such discs also having radial ribs. U.S. Pat. No. 4,530,125 to Hofmann illustrates another such disc also having radial slots, while U.S. Pat. No. 5,418,995 to Rice, et al., depicts such a disc additionally including radially spaced apertures adjacent its outer periphery. Yet another disc having a central aperture whose boundary is designed for receipt by a footpad is shown in U.S. Pat. No. 5,433,985 to Atkins, with this particular disc folding into a "fan shape" for transport and storage.

U.S. Pat. No. 6,122,794 to Atkins describes a component for a swimming pool cleaner identified as an integrally-molded footpad and disc. Notwithstanding the integral molding, the component continues to have a normally circular central aperture whose boundary (rim) is designed to "engage in a groove provided around the bottom of a pool cleaner body." See Atkins, col. 2, 11. 39-40. Joining of the footpad and disc is accomplished via "a ring of thin sectioned material which provide[s] great flexibility of the disc relative to the foot." Id., 11. 53-55 (numerals omitted).

U.S. Pat. No. 7,987,542 to Moore, et al., finally, depicts various discs at least some of which may be multi-piece. Also illustrated are footpads and an apron. Rather than having circular grooves for receiving central circular apertures of discs, some footpads may be elongated as shown in FIG. 12 of the Moore patent. The footpads may, for example, connect directly or indirectly to the apron, especially if the apron is channeled.

SUMMARY OF THE INVENTION

The present invention provides a combined disc and footpad whose attachment to a cleaner body need not occur (or need not occur only) via receipt of a boundary of a central aperture into a groove. Instead, the disc and footpad may be integral and connect to other structure using one or more protrusions extending from the (nominally) main upper surface of the disc. Further, the combined disc and footpad may include a central aperture enabling fluid flow into the cleaner, notwithstanding that the aperture is not needed for attaching the combined device thereto. In certain respects the combined disc and footpad may be similar to that of the Atkins '794 patent, in that the footpad may be considered a "central boss part" and the disc "an integral outer annular part" of the device.

Generally, a combined device of the invention may include a substantially planar section having upper and lower surfaces. If desired, various slits and holes may extend from the upper surface to the lower surface through a thickness of the disc. An outer peripheral region of the disc optionally may include scallops, fins, or both scallops and fins (or other features). Presently-preferred versions of the disc contain only one piece, although multi-piece discs may be included within the scope of the invention as long as a footpad or equivalent is integral with at least one piece of the disc.

As noted above, discs of the invention may continue to have a central aperture. Such aperture need not necessarily be circular, however, nor need it be symmetric about a(n imaginary) center point of a disc. Preferred discs include at least one, and typically two, protrusions configured to attach to one or more other components of an APC. The protrusions may extend upward above the upper surface of the generally planar portion of the disc and, if desired, have complex, non-annular shape. A presently-preferred protrusion is elongate with at least a portion having a generally U- or mushroom-shaped cross-section. One or more alignment openings additionally may be present in the generally planar portion of a disc.

Protruding from the lower surface of the generally planar portion of the disc in the region of the central aperture may be the integral footpad. The footpad may (but need not) resemble conventional separate footpads; regardless, it functions as a wear surface frequently in contact with a pool floor or wall undergoing cleaning. If present, cut-outs in the footpad may permit water to flow into the central aperture.

The height of the (generally inflexible) footpad serves to space much of the lower surface from the pool floor or wall. However, because the generally planar portion of the disc is generally flexible, it tends to droop under force of gravity so that, absent countervailing forces, its periphery too contacts the pool floor or wall. Evacuating the pool cleaner under influence of a pump causes at least the peripheral portion of the disc to seal against the to-be-cleaned surface, allowing debris-laden water contained in the space to enter the central aperture and transit through the cleaner body to an appropriate filter.

It thus is an optional, non-exclusive object of the present invention to provide components of equipment for cleaning fluid-containing vessels such as, but not necessarily limited to, pools and spas.

It also is an optional, non-exclusive object of the present invention to provide combined discs and footpads for pool cleaners.

It is another optional, non-exclusive object of the present invention to provide discs and footpads that are formed (as by molding) integrally.

It is a further optional, non-exclusive object of the present invention to provide components of pool cleaners having generally planar portions and nominally upwardly-extending connectors.

It is an additional optional, non-exclusive object of the present invention to provide components of pool cleaners in which footpads extend nominally downwardly from generally planar portions of the discs.

Other objects, features, and advantages of the present invention will be apparent to those skilled in the art with reference to the remaining text and the drawings of this application.

DETAILED DESCRIPTION

Figure 1A:
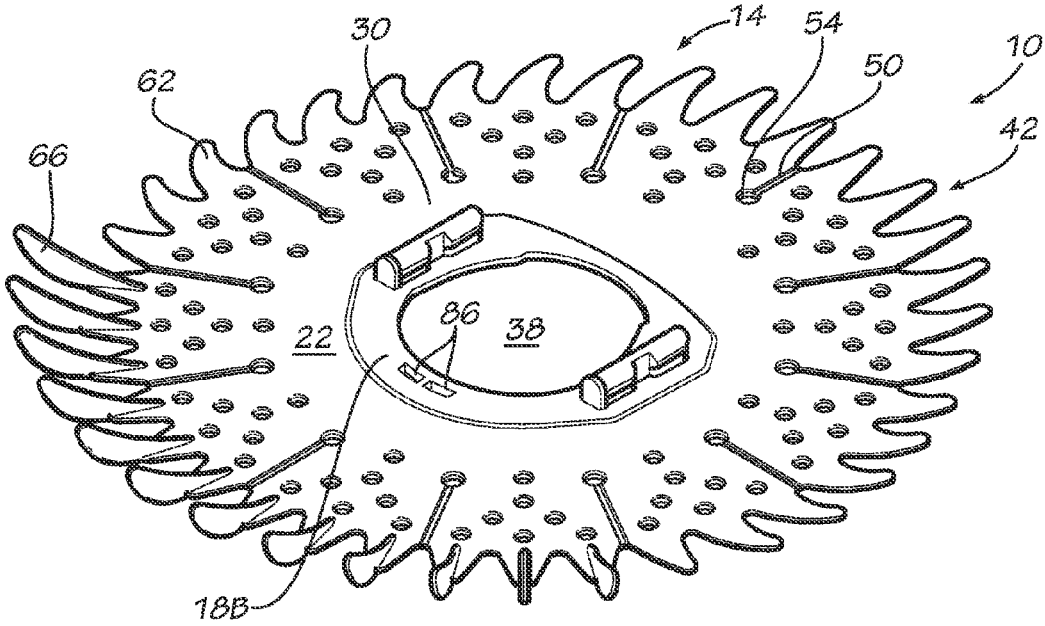
FIGS. 1A-B are perspective views of an exemplary component of the present invention showing, particularly, a nominally upper surface of a generally planar portion of the component.

Illustrated in FIGS. 1-5 is exemplary component 10 consistent with the present invention. Component 10 beneficially may be used as part of an APC—in particular, part of a suction-side hydraulic such cleaner—although it may be used otherwise as well. As shown in FIGS. 1-5, component 10 may include both disc 14 and footpad 18. Disc 14 and footpad 18 advantageously are integrally molded, avoiding any need for the separate footpad of many conventional suction-side APCs.

Disc 14 may comprise nominally upper and lower surfaces 22 and 26, respectively. Each of the surfaces 22 and 26 may have a respective generally planar portion 30 or 34. Component 10 additionally may define central aperture 38, and generally planar portions 30 and 34 may terminate in respective peripheral regions 42 and 46 generally radially opposite central aperture 38. Aperture 38 need not be exactly centered on component 10, however, nor need it be circular in shape as was typical of the prior art.

Figure 1B:
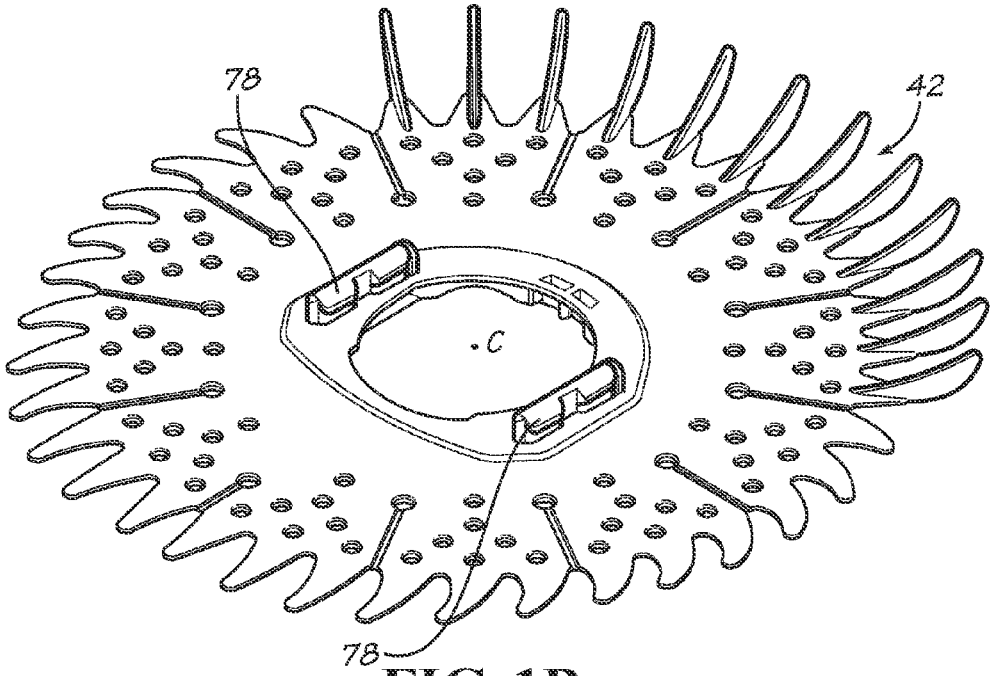
Figure 1C:
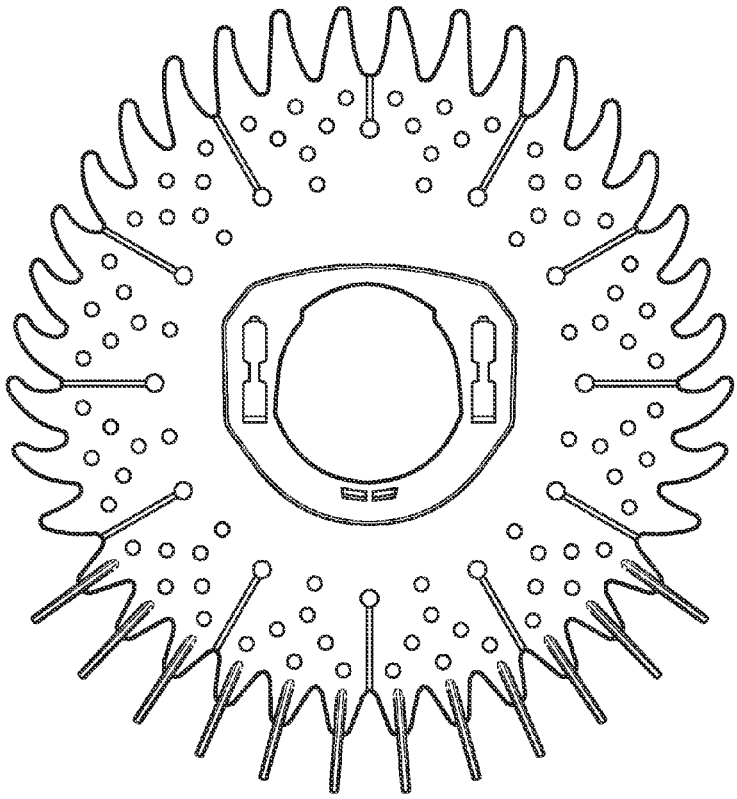
FIG. 1C is a plan view showing, particularly, the nominally upper surface of FIGS. 1A-B.
Figure 2A:
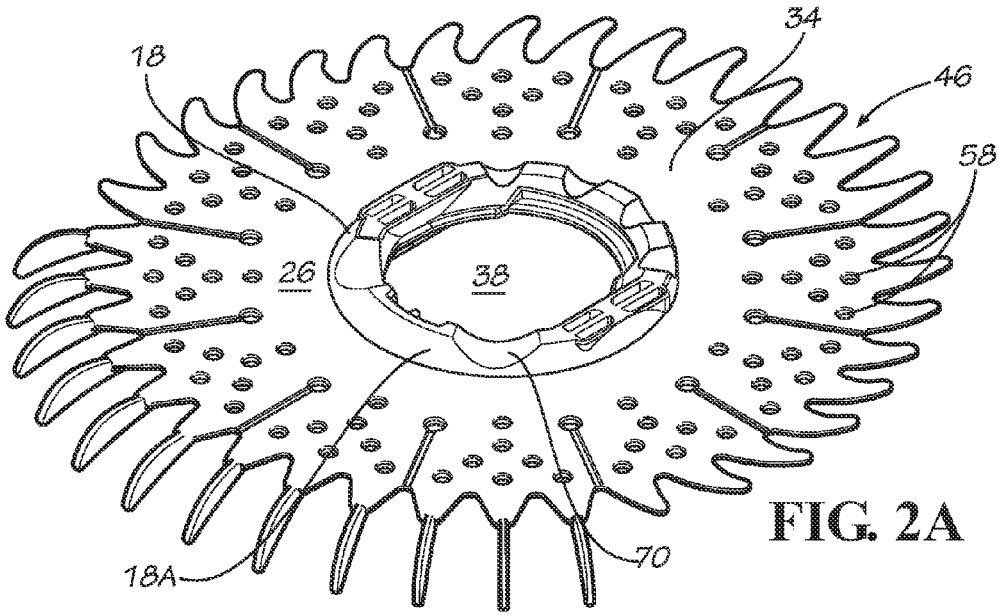
FIGS. 2A-B are perspective views of the component of FIGS. 1A-C showing, particularly, a nominally lower surface of the generally planar portion of the component.
Figure 2B:
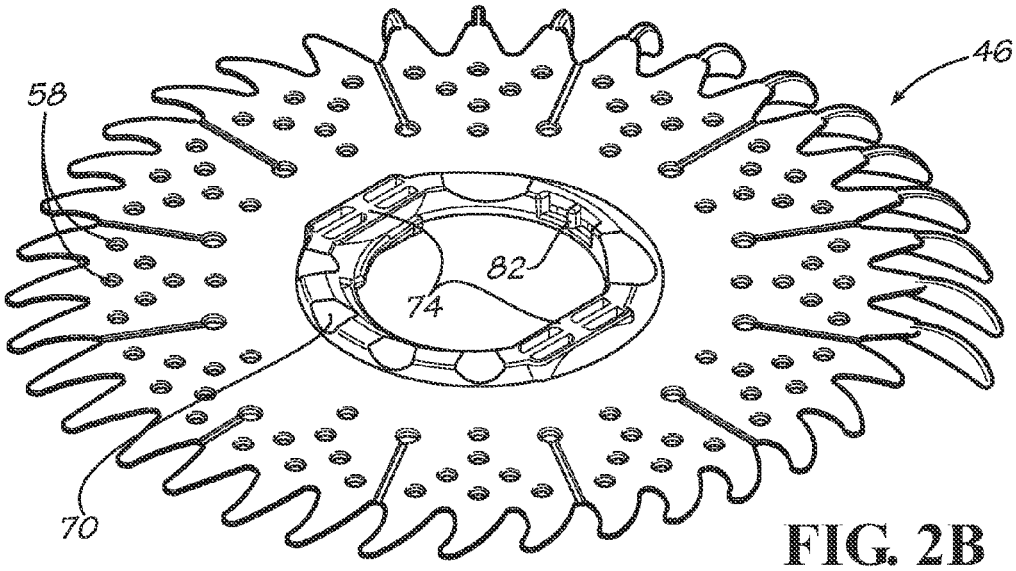
Figure 2C:
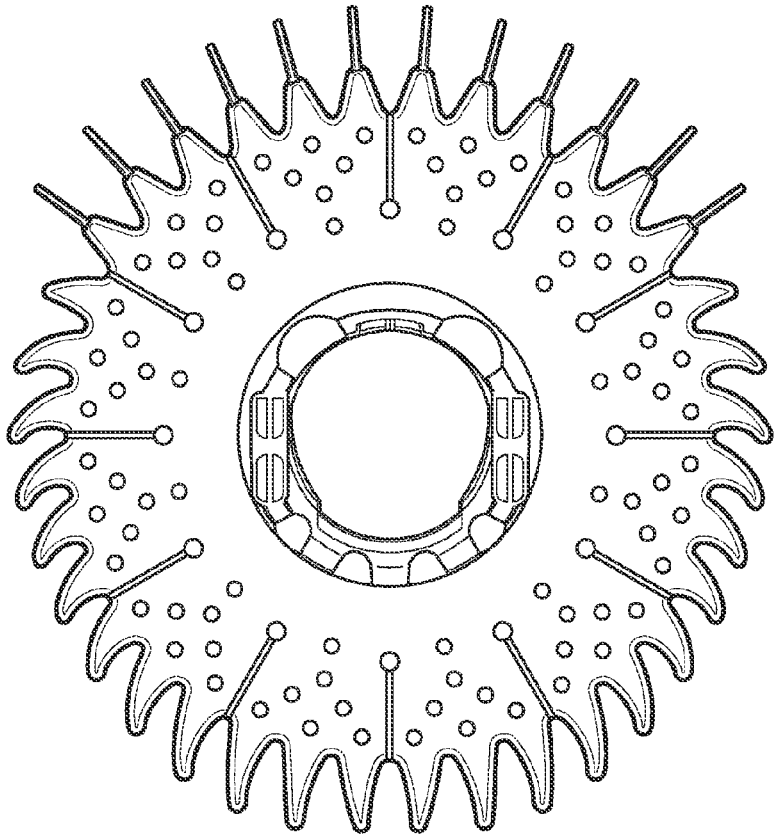
FIG. 2C is a plan view showing, particularly, the nominally lower surface of FIGS. 2A-B.
Figure 3A:
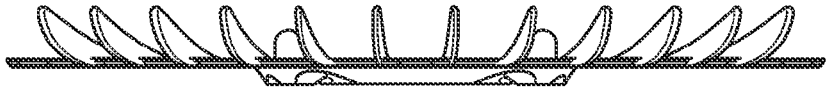
FIGS. 3A-B are elevational views of the component of FIGS. 1A-C.
Figure 3B:
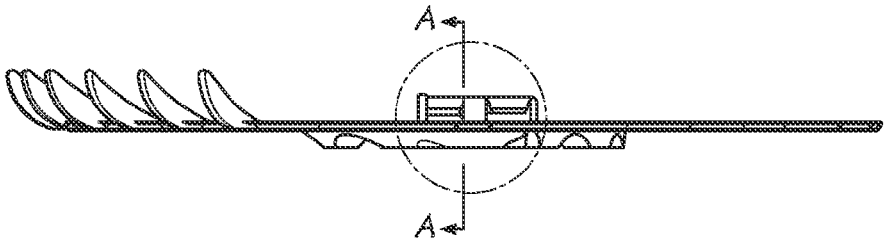
Figure 3C:
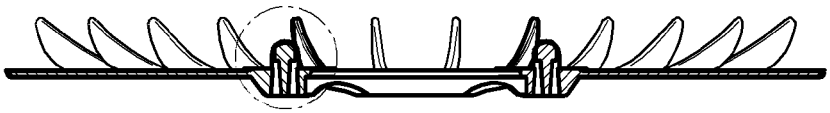
FIG. 3C is a cross-sectional view of the component of FIGS. 1A-C taken along line A-A of FIG. 3B.
Figure 4:
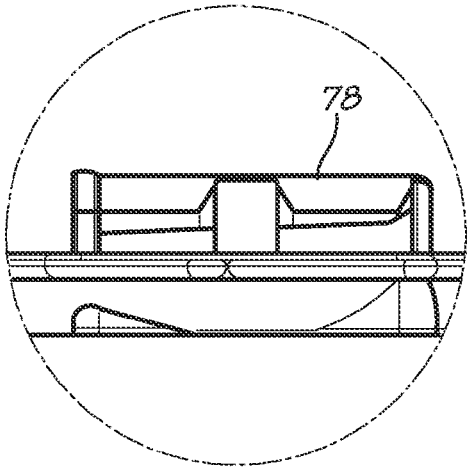
FIG. 4 is a detailed view of a first portion of the component as shown in FIG. 3B.
Figure 5:
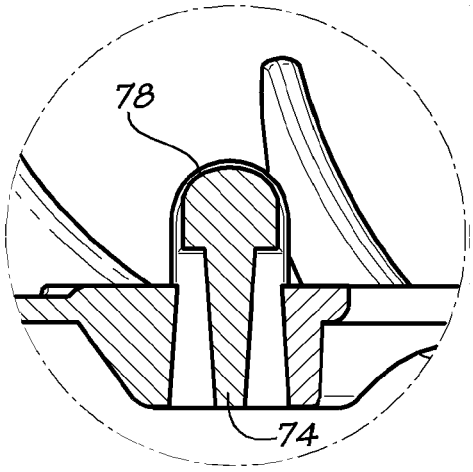
FIG. 5 is a detailed view of a second portion of the component as shown in FIG. 3C.

Disc 14 may, but need not, be generally circularly shaped if desired. Extending radially inward toward central aperture 38 from peripheral regions 42 and 46 may be one or more slits 50 each terminating in an opening 54. Similarly present in peripheral regions 42 and 46 may be multiple openings 58. As shown in FIGS. 1-2, openings 58 may be positioned in sets resembling non-circular portions of "peace" signs. Openings 58 need not be present or, if present, need not be positioned in the depicted manner, however. Slits 50 and openings 54 likewise are optional and, if present, may differ in size, number, and configuration from those shown in the drawings.

Peripheral regions 42 and 46 may be scalloped, incorporating a plurality of scallops 62. Scallops 62, if present, may be spaced regularly or irregularly about the peripheral regions 42 and 46 and have any suitable shape. Moreover, fins 66 may extend upward and outward from scallops 62 over at least a portion of peripheral region 42.

Surrounding part or all of central aperture 38 is footpad 18. Footpad 18 may resemble the separate footpad conventionally used with some APCs. It need not necessarily do so, however, and thus "footpad" as used herein is not intended to equate solely to prior art footpads. As shown in FIGS. 1-5, footpad 18 may include nominally lower portion 18A extending (nominally downward) from lower surface 26 as well as upper portion 18B extending (nominally upward) from upper surface 22.

Lower portion 18A of footpad 18 functions in part as a bearing or wear surface when its associated APC is in use. Lower portion 18A thus is designed for repeated contact with to-be-cleaned surfaces of pools and spas. It thus preferably is thicker and less flexible than disc 14, notwithstanding that it may be made of the same moldable material. One or more cut-outs 70 may be present in lower portion 18 to allow water to flow from areas adjacent lower surface 26 into central aperture 38. Lower portion 18A additionally may, if desired, include support structure 74 for protrusions 78 and support structure 82 for alignment openings 86.

Upper portion 18B of footpad 18 may include protrusions 78 and the alignment openings 86. Preferably two protrusions 78 extend outward (nominally upward) from upper surface 22 and are spaced radially opposite an (imaginary) approximate center point C of aperture 38. More or fewer protrusions 78 may be used, however, and protrusions 78 may be spaced and positioned differently than as shown in the figures.

Protrusions 78 preferably are elongate, with at least portions having generally U-shaped (or mushroom-shaped) cross-section. Regardless of cross-sectional shape, however, protrusions 78 are configured to attach component 10 to a body or other component of an APC. In particular, protrusions 78 are designed to be frictionally received into channels of complementary shape to effect the attachment. One or more alignment openings 86 additionally may receive hooks or other extensions of the body, for example, so as to ensure proper relative orientations of the attached objects.

Accordingly, component 10 effectively combines both sealing and bearing functions in a unitary, integral object. Hence, no separate footpad need ever be created. Moreover, because disc 14 and footpad 18 are integral, no mismatch of the two may occur (as currently happens at times when aftermarket discs with incorrectly sized or shaped central apertures are attempted to be connected to existing footpads). Protrusions 78 provide positive frictional connections to other components, avoiding any requirement for a boundary of central aperture 38 to be fitted into any groove. These and other features of component 10 enhance its usefulness in connection with many APCs.

The foregoing is provided for purposes of illustrating, explaining, and describing embodiments of the present invention. Modifications and adaptation to these embodiments will be apparent to those skilled in the art and may be made without departing from the scope or spirit of the invention. Additionally, words such as (but not limited to) "upper," "lower," "upward," and "downward" are used as though component 10 is in a default position as it would be when attached to a typical APC which is upright. In use, however, the APC—and consequently component 10—likely will not always be upright, at which times an "upper" object may be below a "lower" object, for example. The entire contents of all patents identified in the section of this application headed "Background of the Invention" are incorporated herein by this reference.

What is claimed is:

1. A component of an automatic swimming pool cleaner comprising:

a. a flexible disc; and b. a footpad integrally molded with the flexible disc and including means, comprising distinct, elongate first and second protrusions, for connecting the footpad to another component of the automatic swimming pool cleaner.

2. A component according to claim 1 in which the flexible disc has an upper surface and the first protrusion extends upward above the upper surface when the automatic pool cleaner is upright.

3. A component according to claim 2 in which the second protrusion extends above the upper surface when the automatic pool cleaner is upright.

4. A component according to claim 3 further comprising a non-circular central aperture through which, in use, water may flow.

5. A component according to claim 4 in which the first and second protrusions are spaced radially opposite an approximate center point of the central aperture.

6. A component according to claim 5 in which the footpad further comprises at least one alignment opening.

7. A component according to claim 6 in which the flexible disc has a lower surface and the footpad has a lower portion extending downward below the lower surface when the automatic pool cleaner is upright.

8. A component according to claim 7 in which the upper surface of the flexible disc has a generally planar portion.

9. A component according to claim 8 in which the generally planar portion terminates in a peripheral region comprising at least one slit.

10. A component according to claim 8 in which (i) at least part of the peripheral region is scalloped (ii) at least one fin extends outward from a scallop.

11. A component according to claim 1 in which the first and second protrusions are oriented parallel to one another on the footpad.

12. A component according to claim 1 in which each of the first and second protrusions has generally U-shaped or mushroom-shaped cross section.

13. A component according to claim 1 in which the connecting means is configured to be frictionally received into channels of the other component of the automatic swimming pool cleaner to which the footpad is connected.

14. An automatic swimming pool cleaner comprising:

a. a body; and b. a component comprising:

i. a flexible disc; and ii. a footpad integrally molded with the flexible disc and including means, comprising distinct, elongate first and second protrusions, for connecting the footpad directly or indirectly to the body.

15. An automatic swimming pool cleaner according to claim 14 in which the flexible disc has an upper surface and the first protrusion extends upward above the upper surface when the body is upright.

16. An automatic swimming pool cleaner according to claim 15 in which the second protrusion extends above the upper surface when the body is upright.

17. An automatic swimming pool cleaner according to claim 16 further comprising a non-circular central aperture through which, in use, water may flow.

18. An automatic swimming pool cleaner according to claim 17 in which the first and second protrusions are spaced radially opposite an approximate center point of the central aperture.

19. An automatic swimming pool cleaner according to claim 18 in which the footpad further comprises at least one alignment opening.

20. An automatic swimming pool cleaner according to claim 19 in which the flexible disc has a lower surface and the footpad has a lower portion extending downward below the lower surface when the body is upright.

21. An automatic swimming pool cleaner according to claim 20 in which the upper surface of the flexible disc has a generally planar portion.

22. An automatic swimming pool cleaner according to claim 21 in which the generally planar portion terminates in a peripheral region comprising at least one slit.

23. An automatic swimming pool cleaner according to claim 22 in which (i) at least part of the peripheral region is scalloped and (ii) at least one fin extends outward from a scallop.

24. An automatic swimming pool cleaner according to claim 14 in which the first and second protrusions are oriented parallel to one another on the footpad.

25. An automatic swimming pool cleaner according to claim 14 in which each of the first and second protrusions has generally U-shaped or mushroom-shaped cross section.

26. An automatic swimming pool cleaner according to claim 14 in which the body comprises channels and the first and second protrusions are configured to be frictionally received into the channels for connecting the footpad to the body.

* * * * *